US005850939A

United States Patent [19]

Spector

[11] Patent Number: 5,850,939

[45] **Date of Patent: *Dec. 22, 1998**

[54] SQUEEZE CANTEEN FOR SOFT DRINK

[76] Inventor: Donald Spector, 380 Mountain Rd., Union City, N.J. 07080

[ * ] Notice: Under 35 U.S.C. 154(b), the term of this patent shall be extended for 41 days.

[21] Appl. No.: 498,375

[22] Filed: Jul. 5, 1995

[51] Int. Cl.[6] ..... B67D 5/00

[52] U.S. Cl. ..... 222/78; 222/212; 222/215

[58] Field of Search ..... 222/78, 209, 212, 222/213, 215, 192, 494, 525, 566, 567

[56] References Cited

U.S. PATENT DOCUMENTS

| | | | |
|---|---|---|---|
| 2,197,689 | 4/1940 | Fromm | 222/209 |
| 3,105,612 | 10/1963 | Krasnoff et al. | 222/78 |
| 3,157,314 | 11/1964 | Nadler | 222/212 |
| 3,381,857 | 5/1968 | Francis | 222/215 |
| 4,702,473 | 10/1987 | Paquette | 222/212 |
| 5,094,363 | 3/1992 | Monahan et al. | 222/212 |

*Primary Examiner*—Philippe Derakshani
*Attorney, Agent, or Firm*—Michael Ebert

[57] ABSTRACT

A squeeze canteen for producing, in situ, a soft drink and then dispensing this drink. The canteen includes a collapsible pouch molded to simulate a known character and provided with a female socket forming the mouth of the pouch. Inserted in the socket is a removable male nozzle plug incorporating a normally-closed valve. Deposited in the pouch is a charge of water-soluble flavor crystals. When cold water is poured into the pouch through its mouth, the crystals are then dissolved to produce a soda drink that is then sealed in the pouch by the plug inserted in the socket. To drink from the canteen, the valve is first opened and the pouch is then squeezed to pressurize the soda drink and discharge it from the nozzle plug.

1 Claim, 1 Drawing Sheet

SQUEEZE CANTEEN FOR SOFT DRINK

BACKGROUND OF INVENTION

1. Field of Invention

This invention relates generally to squeeze canteens for dispensing potable liquids, and more particularly, to a squeeze canteen for producing, in situ, a soft drink and for then dispensing this drink.

2. Status of Prior Art

A canteen is a flask for carrying drinking water or other potable liquids. Canteens are now commonly used by hikers and other travelers to carry potable liquids such as drinking water and fruit juice. Usually a canteen takes the form of a metal or plastic flask having a removable screw-on cap. These are not suitable for preschool or very young children; for in order to drink from a conventional canteen, the child must unscrew the cap, which is usually chained to the flask, and then put the threaded neck of the flask into his mouth. Since the flask is filled with liquid and is fairly heavy, a young child runs the risk of striking and damaging his teeth with the hard, threaded neck of the flask.

A conventional canteen operates on the gravity flow principle. In order, therefore, to drink from this canteen, the user must raise it to a level at which the liquid will flow downwardly into his mouth. This presents a problem when the user of the canteen is a child on a moving vehicle, for then it is difficult for the user to hold the canteen steady.

The Wang patent 4,925,040 discloses a child's canteen which does not require the user to lift it to a level above the mouth, for this canteen has associated with a latched cap, a drinking straw assembly, which pops up when the cap is unlatched so that the content of the canteen may be now sucked through the straw.

To overcome the drawbacks of conventional canteens, there is disclosed in the Tardif patent 5,370,79 a squeeze canteen for storing a potable liquid and for ejecting the liquid as a jet stream directly into the mouth of the drinker when the canteen is squeezed.

The Tardif '279 canteen includes a container formed of resilient material for holding the liquid. The container is closed by a removable cap provided with a nozzle in the form of a normally upright, flexible tube mounted on a nipple and projecting from the cap, the inlet of the tube communicating with the container. When the container is squeezed, the resultant internal pressure tube forces liquid from the container through the upright straw then from which it is ejected. Associated with the cap is a crimping device constituted by a flexible lug one end of which is anchored on the cap, the lug being provided with an elongated slot through which the tube extends. The lug is manipulated by the user so that in the drinking mode, it is folded over to permit the tube to assume its normal upright position. In the sealing mode the lug is unfolded to extend away from the cap and in doing so to deflect the tube to impart a bend thereto to block the flow of liquid.

Also disclosing a squeeze canteen for dispensing a liquid is the Tardif patent 5,259,538. A squeeze canteen of the types disclosed in the Tardif patents '279 and '538 are relatively elaborate structures and therefore cannot be marketed at low cost. Also these squeeze canteens are associated with a straw tube which must be put in the user's mouth and may with repeated use not be sterile.

While a child can quench his thirst with pure cold water, most children particularly when attending an amusement or theme park such as Disney World, prefer a cold soft drink.

The problem a parent often in a popular amusement park when accompanying a thirsty child, is that while there are usually cold water fountains available from which the child is free to drink, the cold soft drink the child would prefer is not readily available. Indeed, on a busy day in an amusement park, there are usually long lines extending from the kiosks which sell cold soft drinks. And not only must one wait a fairly long period to obtain a cold soda, but its price is generally quite high, far more so than the going price in a retail supermaket.

It is known to produce a cold soft drink suitable for children by dissolving flavor crystals in cold water, one popular brand of such crystals being the trademarked COOL AID brand. These crystals combine a sweetener with a flavoring agent such as a cherry or orange flavor, to produce a low-cost soft drink acceptable for children.

While at home where a glass, and a stirring spoon are available to produce a cold soft drink from flavor crystals, it is not possible to carry this equipment to an amusement park or other outdoor site to provide children with soft drinks.

SUMMARY OF INVENTION

In view of the foregoing, the main object of this invention is to provide a squeeze canteen for producing, in situ, a cold soft drink and then dispensing the drink.

A significant advantage of this squeeze canteen is that an inexpensive yet satisfying drink may be made available to a child at an amusement or theme park or other outdoor site provided with a cold water supply such as a fountain.

More particularly, an object of this invention is to provide a squeeze canteen of the above type which normally seals the soft drink within the canteen and which dispenses the soft drink only when a valve is opened and the canteen is squeezed to produce a jet stream which is directed into the mouth of the child.

Also an object of this invention is to provide a squeeze canteen of the above type whose container is defined by a collapsible plastic film pouch that is molded to simulate a well-known character thematically related to the amousement park in which the canteen is put to use. Thus if the amusement par is Disney World, the character determined by the molded pouch may be mickey Mouse or any other Disney character.

Briefly stated, these objects are accomplished in a squeeze canteen for producing, in situ, a soft drink and then dispensing this drink. The canteen includes a collapsible pouch molded to simulate a known character and provided with a female socket forming the mouth of the pouch. Inserted in the socket is a removable male nozzle plug incorporating a normally-closed valve. Deposited in the pouch is a charge of water-soluble flavor crystals. When cold water is poured into the pouch through its mouth, the crystals are then dissolved to produce a soda drink that is then sealed in the pouch by the plug inserted in the socket. To drink from the canteen, the valve is first opened and the pouch is then squeezed to pressurize the soda drink and discharge it from the nozzle plug.

BRIEF DESCRIPTION OF INVENTION

For a better understanding of the invention reference is made to the detailed description to follow which is to be read in conjunction with the accompanying drawings of which:

DESCRIPTION OF INVENTION

The Squeeze Canteen

Figure 1:
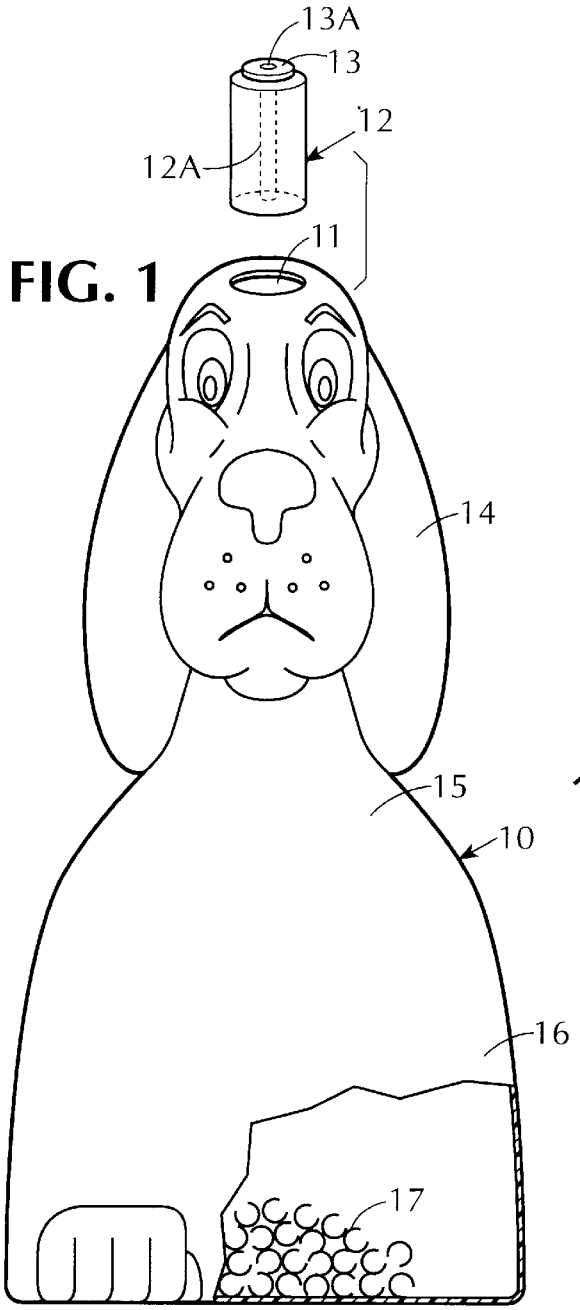
FIG. 1 illustrate the collapsible pouch and the male nozzle plug components of a squeeze canteen in accordance with the invention.

As shown in FIG. 1, the main components of a squeeze canteen in accordance with the invention are a collapsible pouch 10 provided with a ring shaped female socket 11, and a male nozzle plug 12 insertable into the socket plug 11 incorporating a normally-closed valve 13.

Pouch 12 is formed of synthetic plastic film material such as PVC, polyethylene or other flexible thermoplastic of food grade quality. Socket 11 which is formed of rigid plastic material is heat sealed to the pouch to provide a mouth therefor. In its simplest form, the pouch may have a globular or other conventional shape.

In practice the pouch is preferably molded to represent an animated film, comic strip or TV character familiar to children, such as a Sesame Street, a Muppet or Disney character.

The choice of character depends on where the squeeze canteen is to be put to use. Thus if the squeeze canteen is to be marketed in a Disney theme park, the pouch is then preferably in the form of a familiar Disney character, such as Mickey Mouse or Pocahontas.

The character, therefore, has a head 14 on whose surface is silk-screened or otherwise applied the face of the caracter, a neck 15 and a bulbous body 16 whose dimensions are such as to accommodate a sufficient amount of liquid to provide a soft drink. But instead of molding the pouch to resemble a character, it may be shaped and colored to represent a familiar fruit, such as a lemon an orange or an apple, the fruit corresponding to the flavor of the soda drink contained in the pouch.

Deposited in the bulbous body 16 of the pouch is a charge 17 or water-soluble flavor crystals the flavor selected may be related to the nature of the pouch. Thus if the pouch resembles in color and shape an orange, then the flavor crystals may have an orange flavor.

When cold water is poured into pouch 10 through socket 11, the flavor crystals deposited therein are then dissolved the water to provide the desired soft drink. There is no need for a stirrer to distribute the flavor crystals throughout the water, for after the pouch is plugged, it may then be shaken vigorously to fully dissolve the crystals and to uniformly distribute the flavor.

Plug 12 is formed of resilient plastic material so that it is frictionally received in the rigid female socket 11. Valve 13 incorporated in plug 12 is provided with a nozzle orifice 13A that registers with a central bore 12A extending through the plug.

When valve 13 is of the pull-up type, and the valve is pushed down, the passage between bore 12A and orifice 13A is blocked so that no liquid can be ejected from the plug and the pouch is then sealed. But when valve 13 is pulled up, the bore then communicates with the orifice and it is now possible to dispense the liquid. In practice, valve 13 may be of the twist type, so that to open the valve, it is twisted clockwise. Any conventional valve may be incorporated in the plug.

Figure 3:
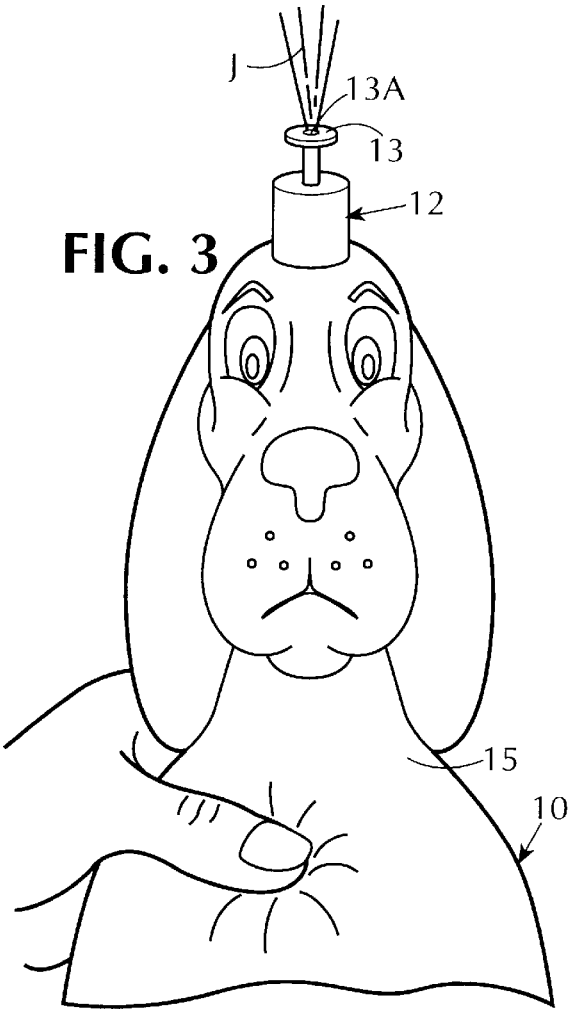
FIG. 3 illustrates the manner in which the squeeze canteen is operated.

To dispense the soft drink, valve 13 is opened and pouch 10 is then squeezed to subject the soft drink contained therein to internal pressure, thereby extruding the soft drink from the nozzle plug as shown in FIG. 3 to produce a liquid jet stream J. This stream is directed by the child squeezing the pouch into his mouth.

The user makes no contact with the nozzle plug, nor does he require a straw to drink, as with prior art squeeze canteens. In practice, valve 13 may be provided with an internal limiter to prevent liquid from squirting out under normal holding conditions in which the child applies holding pressure to the pouch. When, however, the child squeezes the pouch to drink, then the limiter is disabled to permit the liquid to pass through the valve and be discharged.

Modified Plug

Figure 2:
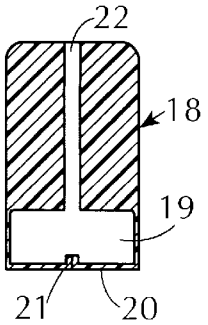
FIG. 2 shows a modified form of nozzle plug.

A simpler form of male nozzle plug which incorporates a self-limiting valve is shown in FIG. 2. Plug 18 which is molded of resilient plastic material includes at its bottom end a circular cavity 19 which is covered by a membrane 20 of elastomeric material having a slit 21 thereon that is normally closed. Cavity 19 communicates with a bore 22 forming the nozzle of the plug. Slit 21 may in practice be defined by abutting lips.

When plug 18 is inserted in socket 11 of the pouch, the pouch is then sealed, for membrane 20 which acts as a closed valve. The liquid pressure applied to membrane 20 when the pouch is held by a child is relatively slight and insufficient to open slit 21 in the membrane. But when the pouch is squeezed, the resultant liquid pressure stretches this membrane inwardly into cavity 19 to open the slit and to permit the liquid to flow from the pouch into bore 22 from which it is discharged.

Packaging

Figure 4:
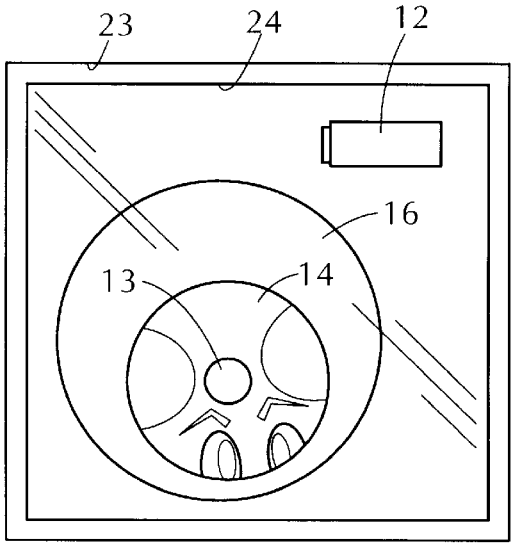
FIG. 4 illustrates a preferred form of package for the squeeze canteen in its collapsed state.

Because pouch 10 is collapsible, the squeeze canteen may be packaged in a compact state as shown in FIG. 4. The pouch in its collapsed condition is placed on the face of a plastic or paper board card 23 on which is also placed adjacent the pouch, the nozzle plug 12.

Covering the flattened, collapsed pouch and the nozzle plug and securing these components to the card is a transparent film 24 of shrink wrap material which exposing the sealed contents of the package.

Though the squeeze canteen has been described as a means for producing a soda drink in situ, in practice it may be used to contain any potable liquid, such as plain water or juice.

While there have been described preferred embodiments of the invention, it is to be understood that many changes may be made therein without departing from the spirit of the invention.

I claim:

1. A squeeze canteen for producing in situ a soft drink and for dispensing this drink comprising:

A. collapsible pouch molded to simulate a character provided with a female socket creating the mouth of the pouch and a charge of flavor crystals deposited in the pouch;

B. a removable male nozzle plug insertable in the socket to seal the pouch after it has been filled with liquid to dissolve the flavor crystals to produce a soft drink, said plug being provided with a normally-closed valve which when opened and the pouch is then squeezed permits the discharge of said soft drink from the nozzle plug; said pouch being formed of synthetic plastic material.

* * * * *